US009169737B2

(12) United States Patent
Aiello et al.

(10) Patent No.: US 9,169,737 B2
(45) Date of Patent: Oct. 27, 2015

(54) GAS TURBINE ENGINE ROTOR SEAL

(71) Applicant: United Technologies Corporation, Hartford, CT (US)

(72) Inventors: Nicholas Aiello, Middletown, CT (US); Carney R. Anderson, East Haddam, CT (US)

(73) Assignee: United Technologies Corporation, Hartford, CT (US)

( * ) Notice: Subject to any disclaimer, the term of this patent is extended or adjusted under 35 U.S.C. 154(b) by 416 days.

(21) Appl. No.: 13/671,205

(22) Filed: Nov. 7, 2012

(65) Prior Publication Data

US 2014/0127007 A1 May 8, 2014

(51) Int. Cl.
*F01D 11/00* (2006.01)

(52) U.S. Cl.
CPC ..... *F01D 11/001* (2013.01)

(58) Field of Classification Search
CPC ..... F01D 11/00; F01D 11/02; F01D 11/001
USPC ..... 415/170.1, 173.7, 174.4, 174.5
See application file for complete search history.

(56) References Cited

U.S. PATENT DOCUMENTS

| | | | |
|---|---|---|---|
| 2,073,514 | A | 3/1937 | Doran |
| 4,526,508 | A | 7/1985 | Antonellis et al. |
| 5,232,339 | A | 8/1993 | Plemmons et al. |
| 5,338,154 | A | 8/1994 | Meade et al. |
| 5,503,528 | A | 4/1996 | Gleizer et al. |
| 6,884,028 | B2 | 4/2005 | Brauer et al. |
| 7,371,044 | B2 | 5/2008 | Nereim |
| 7,918,643 | B2 | 4/2011 | Weaver |
| 2007/0297897 | A1 | 12/2007 | Tran et al. |
| 2009/0238683 | A1 | 9/2009 | Alvanos et al. |
| 2010/0124495 | A1 | 5/2010 | Bifulco |
| 2010/0178160 | A1 | 7/2010 | Liotta et al. |
| 2011/0052376 | A1 | 3/2011 | Sreeram |
| 2011/0116933 | A1 | 5/2011 | Aiello |
| 2012/0177485 | A1 | 7/2012 | Virkler et al. |
| 2012/0297790 | A1 * | 11/2012 | Alvanos et al. ..... 60/796 |

OTHER PUBLICATIONS

International search report for PCT/US2013/068923 dated Aug. 18, 2014.

* cited by examiner

*Primary Examiner* — Edward Look
*Assistant Examiner* — Jason Mikus
(74) *Attorney, Agent, or Firm* — O'Shea Getz P.C.

(57) ABSTRACT

A rotary seal for sealing a bladed rotor of a gas turbine engine to a stator thereof comprises a sealing element and a sealing element support comprising a radially outer edge portion on which the sealing element is fixed, a radially inner mounting portion adapted to be attached to a supported rotor hub, and a flexible, medial web portion extending between the radially outer edge portion and the radially inner mounting portion.

10 Claims, 3 Drawing Sheets

GAS TURBINE ENGINE ROTOR SEAL

BACKGROUND OF THE INVENTION

1. Technical Field

This invention relates generally to gas turbine engines and particularly to a gas turbine engine rotor seal.

2. Background Information

Gas turbine engines such as those that power aircraft and industrial equipment employ a compressor to compress air which is drawn into the engine and a turbine to capture energy associated with the combustion of a fuel air mixture which is exhausted from the engine's combustor. The compressor and turbine employ rotors which typically comprise a multiplicity of airfoil blades mounted on or formed integrally into the rims of a plurality of disks. The compressor disks and blades are rotationally driven by rotation of the engine's turbine. It is a well-known practice to arrange the disks in a longitudinally axial stack in compressive inter-engagement with one another, which is maintained by a tie shaft which runs through axially aligned central bores in the disks. The disks are exposed to working fluid flowing through the engine and therefore, are exposed to extreme heating from such working fluid. For example, in a gas turbine engine high pressure compressor, the disks are exposed to highly compressed air at highly elevated temperatures. This exposure of the disks to such elevated temperatures combined with repeated acceleration and deceleration of the disks resulting from the normal operation of the gas turbine engine at varying speeds and thrust levels may cause the disks to experience low cycle fatigue, creep and possibly cracking or other structural damage especially at the aft end of the compressor disk stack where the temperature and pressure of air flowing through the compressor are highest.

It is a common practice to seal the stator of a gas turbine engine to a rotor thereof to control the flow of working fluid through the engine. For example, it is a known practice to seal the radially inner ends of flow directing vanes in the stator to the engine's rotor to prevent working fluid flowing through the engine from flowing inwardly around the radially inner ends of the vanes and thereby bypassing the flow directing airfoil surfaces of such vanes. Accordingly, it is well-known to provide rotating seal elements such as knife edge seals mounted on the rotor disks which seal to stationary seal elements such as honeycomb or equivalent stationary seal elements mounted on the ends of the stator vanes. The aforementioned low cycle fatigue and creep collectively referred to as thermal mechanical fatigue experienced by disks as noted hereinabove is particularly troublesome with respect to the knife edge seals mounted on disks due to the discontinuities inherent in the mounting of the knife edge seals on the disks. Such discontinuities in the disks associated with the knife edge seals mounted thereon result in high mechanical stress concentrations at the knife edge seals which intensify the risks of damage thereto resulting from the aforementioned thermal mechanical fatigue. Therefore, it will be appreciated that such disk mounted knife edge seals must be periodically removed for normal maintenance involving the repair and/or replacement thereof to maintain the operational efficiency of the engine. It will be appreciated that maintenance repair and/or replacement of knife edge seals mounted on or integral with rotor disks involves the disassembly of the disks from the rotor tieshaft, an expensive and time consuming maintenance procedure.

Therefore, it will be appreciated that a gas turbine engine rotary seal which is less susceptible to thermal mechanical fatigue than prior art disk mounted seals and more easily accessed for repair and maintenance of the seals would be highly desirable.

SUMMARY OF THE DISCLOSURE

In accordance with the present invention, a gas turbine engine having a rotor comprising at least one bladed disk disposed interiorly of a vaned stator includes a rotary seal mounted on the rotor's hub, the seal comprising a sealing element fixed to and supported by a sealing element support comprising a radially outer edge portion on which the sealing element is fixed, a radially inner mounting portion on which the seal is fixed to the engine's rotor such as a knife edge, and a medial flexible web portion disposed between the outer edge portion and the inner mounting portion, the radially inner mounting portion being attached to and supported by a rotor hub at a lateral surface thereof. In an additional embodiment of the foregoing, the sealing element is annular. In an additional embodiment of the foregoing, the hub includes a circumferential groove in the lateral surface thereof, the radially inner mounting portion of the sealing element support being generally aligned with the circumferential groove, the rotor further including a fastener disposed within the circumferential groove in the hub and engageable with the radially inner mounting portion of the sealing element support along the interior of the groove for fixing the sealing element support to the hub. In another additional embodiment of the foregoing embodiment, the fastening element comprises a lock ring. In another additional embodiment of the foregoing, the lock ring comprises a longitudinally outer flange extending radially outwardly from a longitudinally outer edge of the lock ring, the longitudinally outer flange at a longitudinally inner surface thereof engaging the inner mounting portion of the sealing element support at a longitudinally outer surface thereof, the lock ring's longitudinally inner flange extending radially inwardly from the longitudinally outer edge of the lock ring and being received within the circumferential groove in the lateral surface of the hub. In yet a further additional embodiment of the foregoing, the circumferential groove in the lateral surface of the hub is defined by a pair of longitudinally spaced circumferential flanges extending radially outwardly from the lateral surface of the hub. In yet another additional embodiment of the foregoing, the groove in the lateral surface of the hub includes a notch in an inside surface thereof and the radially inner mounting portion of the sealing element support includes a tooth therein, received within the notch for preventing rotation of the sealing element support on the hub. In yet another additional embodiment of the foregoing, the outer lateral surface of the hub is conical and is provided with a pair of radially spaced shoulders extending longitudinally outwardly from the hub, each of the shoulders having radially inner and outer surfaces and the medial web portion of the seal element support includes a pair of radially spaced longitudinally extending flanges, each of the flanges engaging a radially inner surface of a corresponding one of the hub shoulders for radial retention of the seal element support on the hub. In another embodiment of the present invention, the hub comprises an aft hub of a high pressure compressor section of the rotor. In yet an additional embodiment of the foregoing, the sealing element comprises at least one knife edged tooth which may be integral with the radially outer portion of the sealing element support. In another additional or alternative embodiment of the foregoing, the flexible web portion of the seal element is conical in shape.

DETAILED DESCRIPTION OF THE INVENTION

Figure 1:
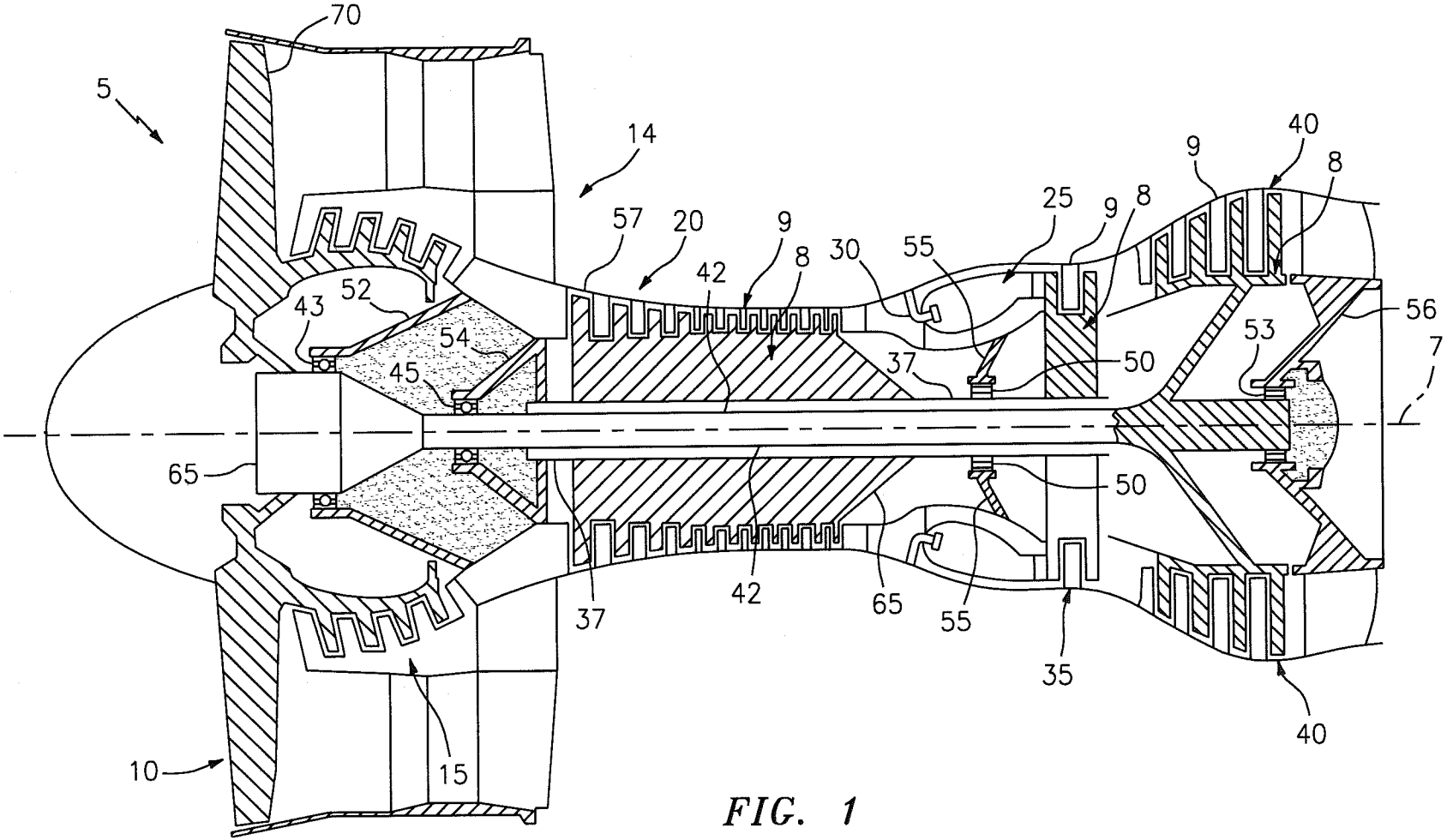
FIG. 1 is a simplified schematic view of a turbofan gas turbine engine of the type employing the rotor seal of the present invention.

Referring to FIG. 1, a turbofan gas turbine engine 5 has a longitudinal axis 7 about which bladed rotors 8 within vaned stator 9 rotate, stator 9 circumscribing the rotors. A fan 10 disposed at the engine inlet draws air into the engine. A low pressure compressor 15 located immediately downstream of fan 10 compresses air exhausted from fan 10 and a high pressure compressor 20 located immediately downstream of low pressure compressor 15, further compresses air received therefrom and exhausts such air to combustors 25 disposed immediately downstream of high pressure compressor 20. Combustors 25 receive fuel through fuel injectors 30 and ignite the fuel/air mixture. The burning fuel-air mixture (working medium fluid) flows axially to a high pressure turbine 35 which extracts energy from the working medium fluid and in so doing, rotates hollow shaft 37, thereby driving the rotor of high pressure compressor 20. The working medium fluid exiting the high pressure turbine 35 then enters low pressure turbine 40, which extracts further energy from the working medium fluid. The low pressure turbine 40 provides power to drive the fan 10 and low pressure compressor 15 through low pressure rotor shaft 42, which is disposed interiorly of the hollow shaft 37, coaxial thereto. Working medium fluid exiting the low pressure turbine 40 provides axial thrust for powering an associated aircraft (not shown) or a free turbine (also not shown) which may be drivingly connected to a rotor of industrial equipment such as a pump or electrical generator.

Bearings 43, 45, 50 and 53 radially support the concentric high pressure and low pressure turbine shafts from separate frame structures 52, 54, 55 and 56 respectively, attached to engine case 57, which defines the outer boundary of the engine's stator 9. However, the present invention is also well suited for mid-turbine frame engine architectures wherein the upstream bearings for the low and high pressure turbines are mounted on a common frame structure disposed longitudinally (axially) between the high and low pressure turbines.

In a manner well-known in the art of gas turbine engines, the blades of rotors 8 may be provided on the peripheries of longitudinal stacks of disks mounted on shafts 37 and 42. Typically, such disks are maintained in compressive interengagement with one another by forward and aft hubs located at the forward and aft ends of the disk stacks. The hubs may be mounted on the shafts by any suitable means such as nuts which are threaded on to the shafts whereby the threaded fasteners urge the hubs against the ends of the disk stacks to hold the disks in the stacks in tight compressive interengagement with each other. An arrangement typical of that used in gas turbine engines for maintaining the fixture of the rotor blade disks on rotor shafts is disclosed in U.S. Pat. No. 7,309,210 to Suciu et al. which is assigned to United Technologies Corporation, the assignee of the present invention.

It is a well-known practice to seal the stator of a gas turbine engine to a rotor thereof to control the flow of working fluid through the gas turbine engine. For example, it is a known practice to seal the radially inner ends of flow directing vanes in the stator to the engine's rotor to prevent working fluid flowing through the engine from flowing radially inwardly, around the radially inner ends of such vanes thereby bypassing the flow directing airfoil surfaces thereof. The present invention represents a significant improvement in such rotary seals for sealing a gas turbine engine rotor to a vaned stator surrounding the rotor. Referring to the drawings collectively, and particularly to FIG. 2 of the drawings, an aft most disk 60 of a high pressure compressor stack of blade supporting disks is maintained in compressive engagement with the remainder of the disks in the longitudinal stack thereof by an aft hub 65 attached to one of the gas turbine engine's rotor shafts by a threaded nut or similar fastener (not shown). As set forth hereinabove, forward and aft end hubs such as that shown as 65 maintain the rotor's blade carrying disks in compressive interengagement with one another, hub 65 compressively bearing against disk 60 circumferentially at radial location 70 on disk 60. A stator vane such as high pressure compressor exit guide vane 75 is located immediately aft of disk 60 and supports at a radially inner end of vane 75, a stationary seal element such as a honeycomb seal element 80. The seal of the present invention, shown generally at 85, seals the disk 60 to the vane 75 to prevent working fluid flowing through the gas turbine engine from flowing around the radially inner tip of vane 75 thereby bypassing the airfoil surface thereof. Rotary seal 85 comprises an annular sealing element 90 comprising a pair of longitudinally spaced annular knife edge teeth 95 which rotationally seal against stationary honeycomb seal 80 mounted at the inner tip of vane 75. Sealing element 90 is integral with sealing element support 100 having an annular radially outer edge portion 105 to which sealing element 90 is affixed, an annular radially inner mounting portion 110 and a medial generally conical flexible web portion 115 disposed between mounting portion 110 and radially outer edge portion 105. Rotary seal 85 is fixed to hub 65 at circumferential groove 120 in the outer lateral surface of hub 65, groove 120 being defined by a pair of longitudinally spaced circumferential flanges 125 extending radially outwardly from the lateral surface of the hub.

Radially inner mounting portion 110 of seal element support 100 is generally radially aligned with groove 120 in hub 65 and fixed thereto by a lock ring fastener 130. Lock ring fastener 130 includes a longitudinally outer flange 135 extending radially outwardly from a longitudinally outer edge of the lock ring, the longitudinally outer flange 135 engaging the inner mounting portion 110 of sealing element support 100 at a longitudinally outer surface thereof. Lock ring 130 also includes a longitudinally inner flange 140 extending radially inwardly from the longitudinally outer edge of the lock ring and is received within groove 120 within hub 65.

Figure 2:
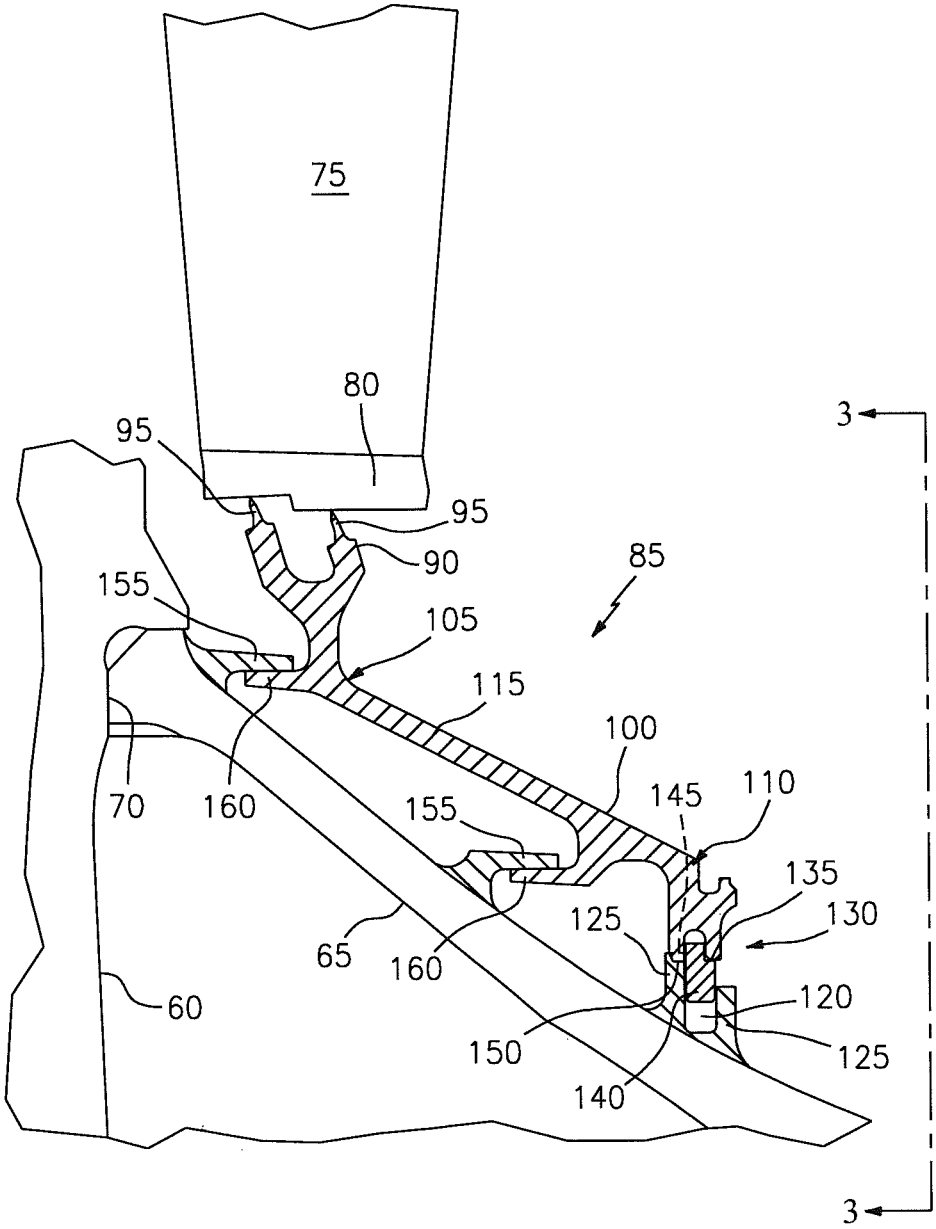
FIG. 2 is a side elevation in partial cross section of a portion of the turbofan gas turbine engine of the type illustrated in FIG. 1, showing the rotor seal of the present invention in section.
Figure 3:
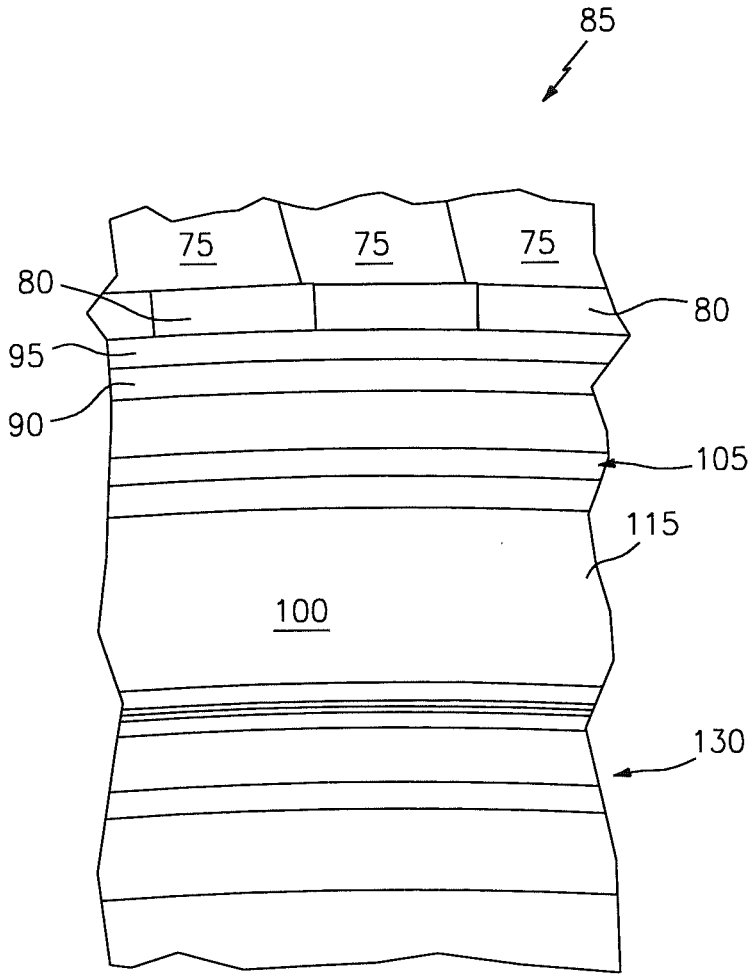
FIG. 3 is an end view of the gas turbine engine rotor seal of the present invention taken in the direction of line 3-3 of FIG. 2.

Still referring to FIG. 2, groove 120 in the lateral surface of hub 65 provided with a notch 145 at an inside surface of the groove, notch 145 receiving a tooth 150 formed integrally with the inner mounting portion 110 to the hub in this manner of seal support 100. Engagement of mounting portion 110 of seal support 100 prevents any relative rotation between seal support 100 and hub 65.

Hub 65 is provided with a pair of radially spaced shoulders 155 extending longitudinally outwardly from the hub, the radially inner surfaces of shoulders 155 engaging the outer surfaces of a pair of spaced longitudinally spaced flanges 160 formed integrally with flexible web portion 115 of seal support 100. This engagement of shoulders 155 with flanges 160 in flexible web portion 115 of seal support 100 reacts the radial loading of the seal of the present invention and distributes radial stress within seal support 100 along flexible web 115.

From the foregoing, it will be appreciated that the gas turbine engine rotor seal of the present invention represents a significant advance over prior art rotor seals. Since seal 85 is mounted on a hub, rather than one of the blade supporting disks, the seal is not exposed to the extreme pressures and temperatures of working fluid flowing over the blades and disks and is therefore, less adversely affected by thermal mechanical fatigue associated with rotor dynamics and extreme working fluid temperatures and pressures. The flexibility of the sealing element support relieves internal stress therein associated with rotor dynamics and working fluid flow. The spaced shoulders on the hub enable the sealing element support to accommodate radial stress along the length of the flexible web, thereby rendering the web less susceptible to the deleterious effects of radial stresses within the hub. Being mounted on a rotor hub rather than a blade supporting rotor disk, the rotor seal of the present invention is removable from the gas turbine engine rotor without major disassembly of the rotor disks for repair and/or replacement of the seal.

Although the present invention has been described within the context of single preferred embodiment thereof, it will be appreciated that various modifications to this preferred embodiment described herein may be made without departing from the present invention. Thus, while the seal element has been described as a knife edge seal element, it will be appreciated that other equivalent seal elements may be employed with equal utility. Also, while various particular shapes of portions of the rotary seal of the present invention have been illustrated and described, it will be appreciated that various other shapes may be employed for such components of the rotary seal of the present invention with equal utility. While the rotary seal of the present invention has been shown and described in conjunction with the aft end of a high pressure compressor disk stack, it will be appreciated that the rotary seal of the present invention may be employed with equal utility in any of the various compressor or turbine stages of a gas turbine engine rotor. Therefore, it will be understood that these and various other modifications to the preferred embodiment illustrated and described herein may be made without departing from the present invention and it is intended by the appended claims to cover any such modifications as fall within the true spirit and scope of the invention herein.

Having thus described the invention, what is claimed is:

1. In a gas turbine engine having a bladed rotor disposed within and circumscribed by a vaned stator, said rotor comprising at least one bladed disk disposed longitudinally interiorly of a hub having a lateral surface, said rotor including a rotary seal for sealing said rotor to said stator, said seal comprising:

a sealing element being supported by a sealing element support comprising:

a radially outer edge portion, said sealing element being fixed to said radially outer edge portion;

a radially inner mounting portion; and a medial, flexible web portion disposed between said outer edge portion and said inner mounting portion;

said radially inner mounting portion being attached to and supported by said hub at said lateral surface thereof;

wherein said hub includes a circumferential groove in said lateral surface thereof, said radially inner mounting portion of said sealing element support being generally aligned with said circumferential groove in said lateral surface of said hub, said rotor further including a fastener disposed within said groove and engageable with said radially inner mounting portion of said sealing element support along the interior of said groove for fixing said sealing element support to said hub;

wherein said fastening element comprises a lock ring.

2. The gas turbine engine rotor of claim 1 wherein said sealing element is annular.

3. The gas turbine engine rotor of claim 1 wherein said lock ring comprises:

a longitudinally outer flange extending radially outwardly from a longitudinally outer edge of said lock ring, said longitudinally outer flange, at a longitudinally inner surface thereof engaging said inner mounting portion of said sealing element support at a longitudinally outer surface thereof; and a longitudinally inner flange extending radially inwardly from said longitudinally outer edge of said lock ring and being received within said circumferential groove in said lateral surface of said hub.

4. The gas turbine engine rotor of claim 1 wherein said circumferential groove in said lateral surface of said hub is defined by a pair of longitudinally spaced circumferential flanges extending radially outwardly from said lateral surface of said hub.

5. The gas turbine engine of claim 1 wherein said groove in said lateral surface of said hub includes a notch in an inside surface thereof and said radially inner mounting portion of said sealing element support includes a tooth therein received with said notch for preventing rotation of said sealing element support on said hub.

6. The gas turbine engine rotor of claim 1 wherein said outer lateral surface of said hub is generally conical and is provided with a pair of radially spaced shoulders extending longitudinally outwardly from said hub, said pair of shoulders each having radially inner and outer surfaces, and said medial web portion of said seal element support including a pair of radially spaced longitudinally extending flanges, each of said web portion flanges including radially inner and outer major surfaces, each of said flanges engaging said radially inner surface of a corresponding one of said hub shoulders for radial retention of said seal element support on said hub.

7. The gas turbine engine rotor of claim 1 wherein said sealing element comprises at least one generally annular knife edged tooth.

8. The gas turbine engine rotor of claim 1 wherein said sealing element is integral with said sealing element support.

9. The gas turbine engine rotor of claim 1 wherein said medial, flexible web portion of said seal element support is generally conical in shape.

10. The gas turbine engine rotor of claim 1 wherein said hub comprises the aft hub of a high pressure compressor section of said bladed rotor.

* * * * *